United States Patent [19]

Kulik et al.

[11] 4,176,391

[45] Nov. 27, 1979

[54] SHOCK ISOLATING LAMP ASSEMBLY

[75] Inventors: George J. Kulik, Valley Stream, N.Y.; Michael C. Meslink, Ramsey; James P. Mulder, Oakland, both of N.J.

[73] Assignee: Abex Corporation, New York, N.Y.

[21] Appl. No.: 910,155

[22] Filed: May 26, 1978

[51] Int. Cl.[2] ..... F21V 15/04

[52] U.S. Cl. ..... 362/390; 339/61 L; 339/93 L; 339/119 L; 339/125 L; 362/61; 362/288; 362/369

[58] Field of Search ..... 362/390, 288, 369, 61; 339/93 L, 61 L, 119 L, 125 L

[56] References Cited

U.S. PATENT DOCUMENTS

| | | | |
|---|---|---|---|
| 2,431,895 | 12/1947 | Tornblom | 362/390 |
| 2,846,571 | 8/1958 | Rothen | 362/390 |
| 3,059,104 | 10/1962 | Dickson | 362/288 |
| 3,145,933 | 8/1964 | Dickson | 362/340 |
| 3,208,031 | 9/1965 | Dickson | 362/61 |
| 3,327,110 | 6/1967 | Baldwin | 362/390 |
| 3,980,878 | 9/1976 | Crompton | 362/375 |

FOREIGN PATENT DOCUMENTS

| | | | |
|---|---|---|---|
| 21127 | of 1907 | United Kingdom | 362/390 |

*Primary Examiner*—Benjamin R. Padgett
*Assistant Examiner*—T. S. Gron
*Attorney, Agent, or Firm*—Blum, Moscovitz, Friedman & Kaplan

[57] ABSTRACT

A shock isolating lamp assembly for a vehicle lamp including an improved shock isolating mounting is provided. The assembly includes a lamp housing for receiving a lens and a shock isolating mount of a resilient material including a central body portion formed with a vertical opening for receiving a lamp socket and two opposed pairs of parallel arms symmetrical to the center line extending outwardly from the body in a plane. The arms are spaced apart a distance approximately the diameter of the lamp socket. Each pair of arms is joined to a perpendicular mounting bar of the same resilient material which cooperates with a pair of opposed mounting tracks extending into the lamp housing. The lamp socket is substantially tubular, open at the top and bottom end and formed with a pair of opposed barbs for engagement by a pair of opposed recesses formed in the inner wall of the mount body portion for retaining the socket therein.

11 Claims, 5 Drawing Figures

SHOCK ISOLATING LAMP ASSEMBLY

BACKGROUND OF THE INVENTION

This invention relates generally to an improved shock isolating lamp assembly for use as an automotive vehicle lamp, and particularly to an improved shock isolating mount for a vehicle lamp assembly. Automotive vehicles, and particularly commercial vehicles, are subjected to recurrent road shocks in traveling over the highway. These road shocks, transmitted through the frame of the vehicle, affect the relatively fragile filaments of the lamp bulbs in the marker, signalling and driving lamps of the vehicle, so that such bulbs break or become inoperative rather frequently due to the road shocks. Thus the lamp bulbs must be replaced at rather frequent intervals. With some types of lamps, such replacement is rather difficult for the driver of the vehicle to perform on the road. In addition, the driver is frequently unaware that the lamp bulbs on his vehicle have broken, or the lamps are inoperative, as his opportunity for observing the lamp condition occurs only when the vehicle is stopped, as at a rest area or during a change of drivers.

Various means have been proposed to provide shock-free mounting for an automotive vehicle lamp mounting. For example, in U.S. Pat. No. 3,059,104 issued to Dickson on Oct. 16, 1962, Dickson proposed a mounting including a soft rubber receptacle arranged to receive wings on the lamp socket in a fixed part of the lamp housing. In U.S. Pat. No. 3,208,031, also issued to J. B. Dickson on Sept. 21, 1965, a soft rubber cup for supporting a conventional metal lamp socket was proposed. This cup was supported in the lamp socket by flexible fingers engaging a metal bracket mounted to the lamp housing. In addition, U.S. Pat. No. 3,980,878 issued to K. J. Crompton on Sept. 14, 1976 similarly proposes a tubular resilient member with radially extending ear mounting portions for retaining a metal lamp socket. The resilient ears are supported directly in cavities formed in the lamp housing. As noted in this patent, the construction is effective for dampening of vibrations and mild shocks and offers some resistance to severe shocks.

While these proposals have improved the shock isolation of a vehicle lamp thereby extending its life, these proposals have been less than fully satisfactory. Accordingly, it is desirable to provide an improved shock isolating lamp construction which will further reduce shock and vibration imparted to an automotive vehicle lamp and which protects the lead wires from strain in addition to providing improved shock isolation. In addition, it is desirable to provide an improved shock isolating lamp construction which may be more easily constructed and readily assembled than those suggested in the prior art.

SUMMARY OF THE INVENTION

Generally speaking, in accordance with the invention, an improved shock isolating lamp assembly for use as an automotive vehicle lamp is provided. The lamp assembly includes a substantially cup-shaped lamp housing having a pair of opposed elongated shock isolating mount receiving tracks extending substantially rearwardly into the recessed portion of the lamp housing. The shock isolating mount is formed from a resilient material having a resonant frequency substantially less than that of the lamp filament. The mount includes a central body portion having a substantially vertical axis open along its upper surface and formed with an interior diameter suitable for receiving a tubular metal lamp socket. A pair of opposed barb receiving recesses are formed on the interior wall of the mount opening to engage a pair of socket barbs projecting outwardly from the wall of the lamp socket for retaining the lamp socket in the mount opening. The mount further includes four outwardly extending arms in two pairs on opposed sides of the body, each pair including arms which are substantially parallel and spaced apart from the center line of the opening at a distance about the diameter of the lamp socket. The outboard ends of each pair of arms is joined to a perpendicular mounting member slideably engageable by the receiving tracks of the lamp housing for mounting the shock isolating mount therein.

Accordingly, it is an object of the invention to provide an improved shock isolating lamp assembly.

Another object of the invention is to provide a shock isolating lamp assembly including an improved shock isolating mount therein.

A further object of the invention is to provide an improved shock isolating lamp assembly providing improved shock absorbing to a lamp and relieving strain on electrical lead wires.

Still another object of the invention is to provide an improved shock isolating lamp assembly of simplified construction suitable for automated manufacture and assembly for further reducing shock and vibration imparted to a vehicle lamp.

Still a further object of the invention is to provide an improved metal lamp socket for engaging the shock isolating mount of the invention.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
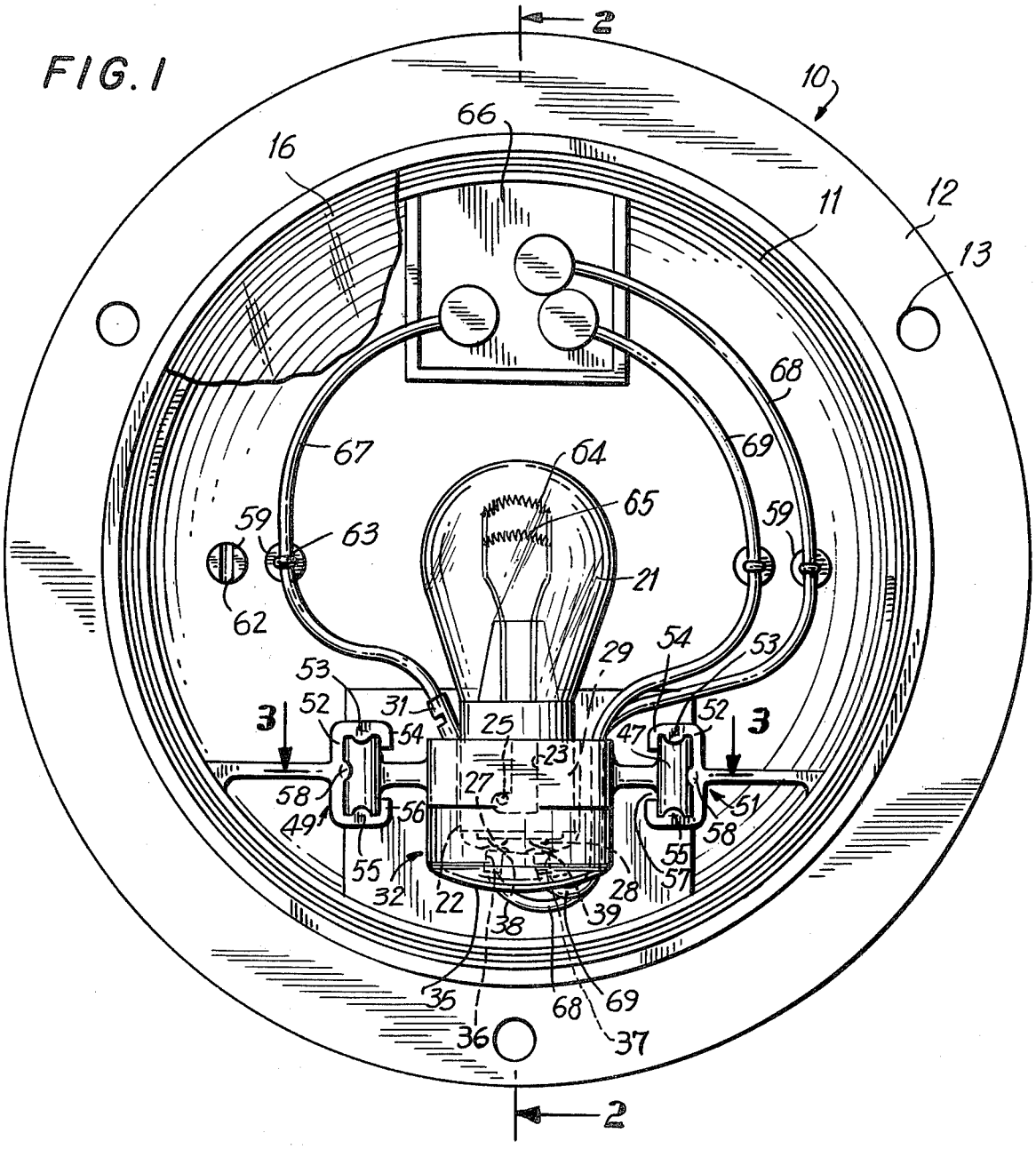
FIG. 1 is an elevational view of a shock isolating lamp assembly, with lens removed, constructed and arranged in accordance with the invention.

Referring specifically to FIG. 1, a shock isolating lamp assembly constructed and arranged in accordance with the invention is shown generally as 10. Assembly 10 includes a substantially cylindrical cup-shaped housing 11 having a radially extending peripheral mounting flange 12 formed with apertures 13 for flush mounting assembly 10 with housing 11 extending through a circular recess in a mounting surface. Housing 11 is formed with a laterally extending seating surface 14 formed inwardly from mounting flange 12 for mating with the mounting surface. Housing 11 is formed further with an inwardly facing lens seating surface 15 for receiving a lens 16.

Figure 2:
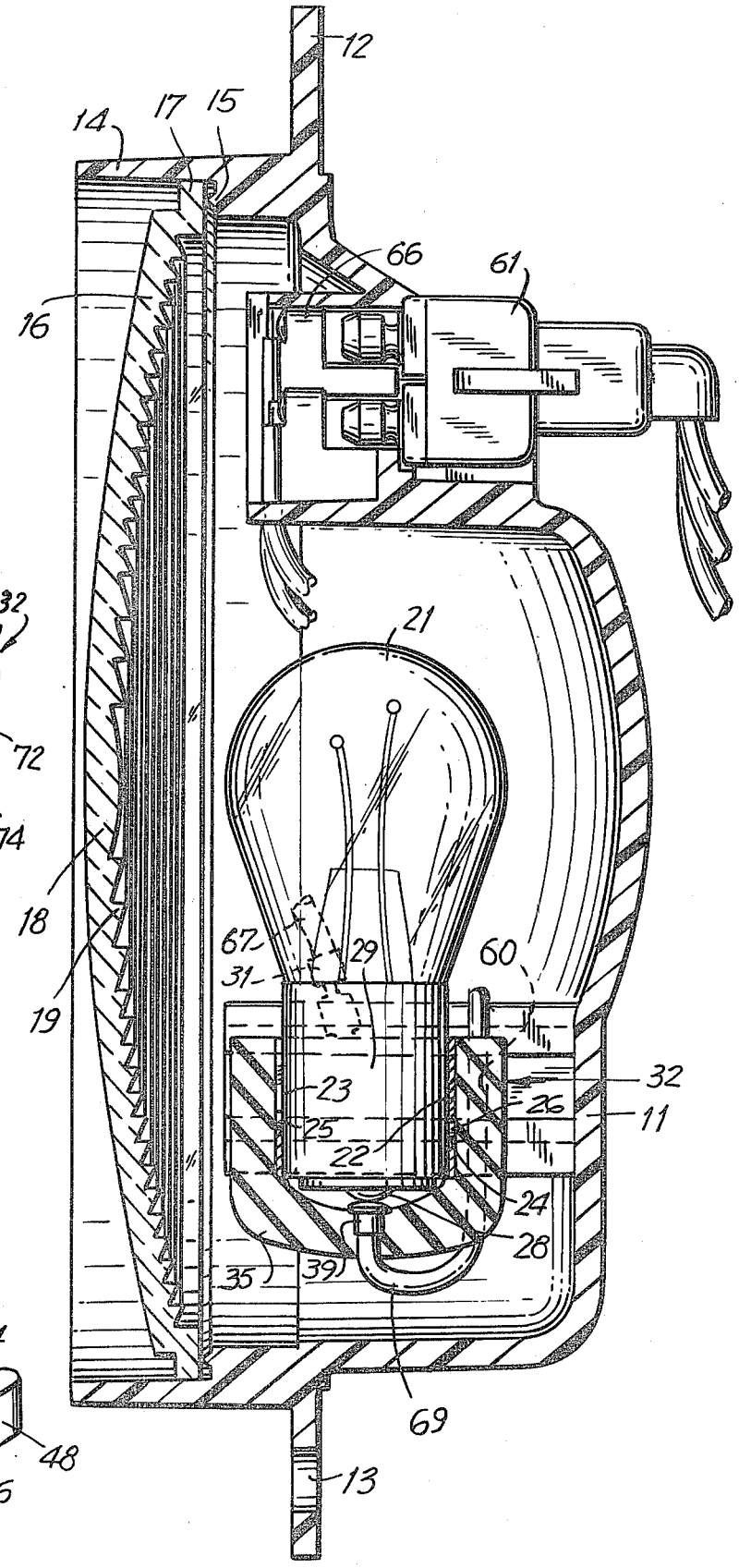
FIG. 2 is a sectional view taken along line 2—2 of FIG. 1.

As shown more clearly in FIG. 2, lens 16 is generally outwardly convex and is formed with a peripheral seating flange 17 formed about the circumference of lens 16 for cooperating with lens seating surface 15 formed in housing 11. Generally lens 16 is formed with a bull's-eye 18 which may be clear, and the interior portions of the surface of lens 16 surrounding bull's-eye 18 are formed with a plurality of concentric circular ribs 19 to enhance the refractive property of lens 16 in a lamp constructed and arranged in accordance with the invention. Lens 16 may be sealed in lamp assembly 10 in compressive relation between seating surface 14 and lens seating surface 15 with a sealing gasket (not shown), a sealant or by sonic welding. Lens 16 is often colored red, amber or crystal for use on automotive vehicles, such as trucks, buses and other heavy equipment.

Figure 4:
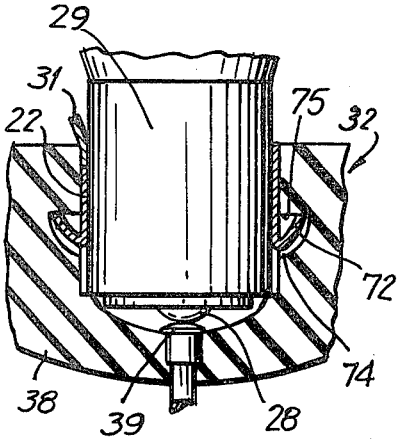
FIG. 4 is a partial sectional view taken along line 4—4 of FIG. 3.
Figure 5:
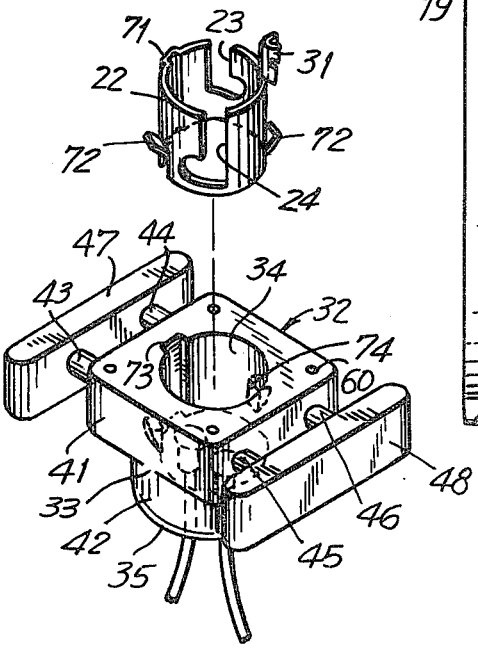
FIG. 5 is an exploded perspective view of the shock isolating mount moldment and lamp socket constructed and arranged in accordance with the invention in the shock isolating lamp assembly depicted in FIG. 1 and FIG. 2.

Referring now to FIG. 1, a lamp 21 of the stop/directional/tail variety, commonly identified as No. 1157, is mounted in a tubular metal lamp socket 22 supported in a resilient shock isolating moldment shown generally as 32 constructed and arranged in accordance with the invention. Lamp socket 22 is open at its upper and lower end and is formed with an upper L-shaped bayonet mounting slot 23 and a lower L-shaped bayonet mounting slot 24 for receiving an upper cooperating pin 25 and a lower opposed cooperating pin 26 formed on the side of a metal base 29 of lamp 21. Lamp socket 22 is also formed with a lateral aligning projection 71 and a pair of opposed barbs 72 extending outwardly from the lower portion thereof for mounting and retaining lamp socket 22 in moldment 32 as shown in FIGS. 4 and 5 which will be described more fully below. When lamp 21 is inserted into lamp socket 22 and pins 25 and 26 are engaged in slots 23 and 24 a first lamp contact 27 and a second lamp contact 28 disposed on the bottom of the metal base 29 of lamp 21 extend through socket 22.

Lamp socket 22 formed with a ground lug 31 along its upper edge is mounted in moldment 32 which includes a central body portion 33 formed with a substantially cylindrical opening 34 and a bottom wall 35 for receiving lamp socket 22. The interior wall of moldment 32 is formed with a socket aligning slot 73 and a pair of opposed barb retaining recesses 74 having a substantially horizontal top wall 75 for aligning and retaining lamp socket 22 in opening 34. During assembly, projection 71 is aligned with slot 73 so barbs 72 are aligned with recesses 74 for receiving and retaining lamp socket 22 in moldment 32, in fish-hook fashion as shown in FIG. 4. Bottom wall 35 of moldment 32 is formed with a first opening 36 and a second opening 37 for passing therethrough the lead wires for lamp 21 and for seating therein a first electrical contact 38 and a second electrical contact 39 adapted to cooperate with first lamp contact 27 and second lamp contact 28, respectively, when lamp 21 is secured in lamp socket 22.

Figure 3:
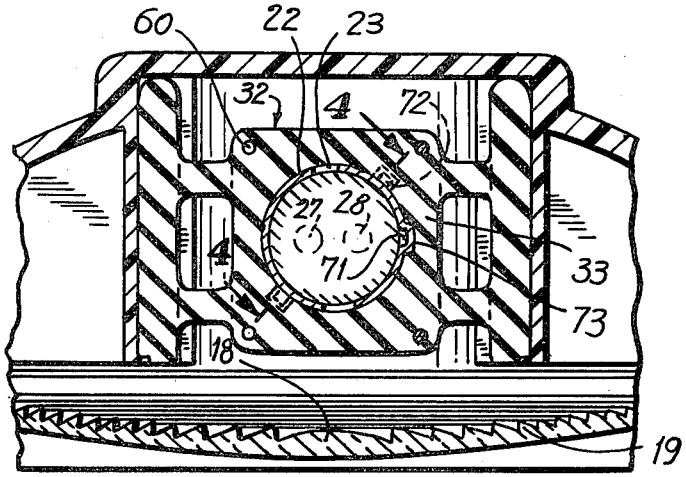
FIG. 3 is a partial sectional view taken along line 3—3 of FIG. 1.

Referring now to FIGS. 3 and 4, the alignment of lamp socket 22 and moldment 32 is shown and the details of construction of moldment 32 will be described. Body portion 33 of moldment 32 is formed with a substantially tubular lower portion 42. Moldment 32 includes a first pair of parallel arms 43 and 44 and a second pair of opposed parallel arms 45 and 46 extending outwardly from opposite surfaces of upper portion 41 of body 33 and lie in the same plane. First pair of parallel arms 43 and 44 and second pair of substantially parallel arms 45 and 46 each are equally spaced apart from each other and preferably equidistant from the center line through the center of lamp socket 22. Each pair of arms 43 and 44, and 45 and 46 is spaced apart a distance approximately the diameter of lamp socket 22. The outward ends of first and second pair of parallel arms are joined to integral mounting bars 47 and 48, respectively, disposed perpendicular to each pair of arms and lying in the same plane for inserting shock isolating mount moldment 32 into housing 11. Mounting bars 47 and 48 are formed with a substantially rectangular cross-section for cooperating with a first mounting track 49 and a second mounting track 51 formed in housing 11 as will be fully described below.

Moldment upper portion 41 is formed with a larger cross-sectional area than tubular lower portion 42 so that the corners of upper portion 41 overhang lower portion 42. In each over-hanging corner of upper portion 41, an opening 60 is formed therethrough for compressively receiving an electrical lead for lamp 21. By providing openings 66 in accordance with this aspect of the invention, strain relief is provided between the respective electrical leads and electrical contacts 27 and 28.

Referring again to FIG. 1, first mounting track 49 and opposed second mounting track 51 for receiving first mounting bar 47 and said mounting bar 48, respectively, are disposed in the lower region of lamp housing 11 and extend from the front of lamp housing 11 at lens seating surface 15 towards the rear wall of lamp housing 11. Mounting tracks 49 and 51 are formed with a substantially rectangular cross-section in front plan view as shown in FIG. 1 for receiving and cooperating with moldment mounting bars 47 and 48. Each mounting track includes an outer wall 52, an upper wall 53 formed with a downwardly projecting lip 54 and a lower wall 55 with an upwardly projecting lip 56 for providing an inwardly facing mounting opening 57. By mounting moldment 32 in this manner, mounting bars 49 and 51 and moldment 32 may be securely fastened in lamp housing 11 without interferring with the deflection of the arms during vibration of assembly 10. Mounting bars 47 and 48 are compressively held in mounting tracks 49 and 51 once slideably inserted therein and are secured therein by heat sealing at the front end of mounting tracks 49 and 51 at heat stakes 58.

Lamp housing 11 is also formed on its inner wall with a plurality of lead posts 59 for supporting lead wire running from a male lead plug 61 releasably secured at the upper rear portion of lamp housing 11, as shown in FIG. 2. Lead posts 59 are substantially cylindrical projections formed with a slot 62 for inserting a lead wire which is then secured by a heat stake 63. Lamp 21 illustrated in FIGS. 1 and 2 as noted is a stop/directional/-tail signal variety and the following description of the leads and electrical contacts will be directed thereto. It is to be understood that a shock isolating lamp assembly constructed and arranged in accordance with the invention is not limited to this type of lamp which is set forth by way of example only.

Stop/directional/tail lamp 21 has a stop/directional filament 64 and a tail filament 65 and three electrical connections, including metal lamp base 29 as the ground, first contact 27 for stop/directional filament 64 and second contact 28 for tail filament 65. The lead wires running between a female receptacle 66 formed in lamp housing 11 for cooperating with male plug 61, include a ground lead 67, a stop/directional lead 68 running to first electrical contact 38 in compressive relation to first lamp contact 27 and a tail lead 69 running to second electrical contact 39 in compressive relation to second lamp contact 28.

First and second electrical contacts 38 and 39 are rivet-shaped with a bevel portion resting on the inner surface of moldment bottom wall 35. When lamp 21 is inserted into socket 22 and turned into L-shaped bayonet slots 23 and 24, the resilient force of moldment bottom wall 35 biases lamp pins 25 and 26 against slots 23 and 24 for securing lamp 21 in socket 22 and for maintaining electrical contact between electrical contacts 38 and 39 and lamp contacts 27 and 28.

Shock isolating mount moldment 32 is formed from a resilient material which retains its energy isolation characteristics of about 45–55, measured on a Shore A Durometer, between operating temperature ranging from about −40° F. to 300° F. It is desirable to maintain these energy isolation characteristics as temperatures within housing 11 often reach 200°–280° F. A silicon rubber is particularly well suited for this application as silicon rubber will maintain its configuration without permanent setting up when exposed to temperatures as high as 500° F. These energy isolation, configuration maintaining the shock isolating properties of moldment 32 maintain the compressive relationship between lamp contacts 27 and 28 and electrical contacts 38 and 39.

The natural frequency of the moldment must be substantially less than the natural frequency of the lamp filament to avoid reinforcement of vibration in the lamp filament. For example, in a No. 1157 bulb weighing about 10 grams, the stop/directional/tail signal illustrated in the figures, the natural frequency of the filament is about 280–420 Hz. In the embodiment of the invention, the natural frequency of the shock isolating moldment with the bulb inserted is in the range of about 45–55 Hz. Silicon rubbers particularly well suited for use in accordance with the invention are GE 555 and GE 556 available from the General Electric Company.

In the embodiment illustrated in FIG. 4, the shock isolating mount moldment arm should have a cross-sectional diameter from about 0.14 to 0.16 inches, and preferably about 0.15 inches in diameter. The arm length must be short enough so that shock isolating moldment 32 with bulb 21 inserted therein will maintain its relative position within lamp housing 11 and there will not be undue deflection. For example, the length of the arm may vary between about 0.2 inches and 0.3 inches, and preferably are about 0.250 inches in length. If a larger length is desired for use in a larger lamp housing or for use with a heavier bulb and lamp socket, the diameter of arms 43, 44, 45 and 46 should be correspondingly increased.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A shock isolating vehicle lamp assembly comprising:

a lamp housing defining a lamp cavity and a lens forming a surface of said assembly;

a pair of opposed substantially parallel mounting tracks spaced apart from each other and disposed in said lamp housing within said cavity; and a resilient shock isolating moldment adapted to be mounted on and between said mounting tracks, said moldment including a central body portion formed with a substantially cylindrical opening therein having a central axis for retaining a metal lamp socket, said moldment further including a pair of opposed arm means extending outwardly in a plane perpendicular to said central axis of said moldment, each said arm means joined to a transverse mounting bar, said mounting bars adapted to be engaged by said opposed pair of mounting tracks.

2. The assembly of claim 1, wherein each said arm means is a pair of substantially parallel elongated spaced arms joined to one of said mounting bars.

3. The assembly of claim 2, wherein each pair of opposed arms is symmetrically positioned with respect to said cylindrical opening wherein said assembly includes a lamp socket in said cylindrical opening and wherein each pair of arms is spaced apart a distance substantially equal to the diameter of said lamp socket.

4. The assembly of claim 3, wherein said arms are substantially cylindrical and the width of each mounting bar at its connection to the cylindrical arms is greater than the diameter of each said arms, and each mounting track for receiving said mounting bar is constructed and arranged to avoid contact with said arms so as to avoid interference with said arms during deflection thereof as a result of shocks applied to said assembly.

5. The assembly of claim 4, wherein said body portion of said moldment is formed with an upper portion and a lower portion with parts of the upper portion overhanging said lower portion, and an opening formed in said overhanging region of said upper portion for compressively receiving an electrical lead which supplies current to a lamp mounted in said lamp socket for relieving strain on an electrically connected end of an electrical lead.

6. The assembly of claim 5, wherein said central body portion of said moldment is formed with a bottom wall having at least one opening therethrough for receiving an electrical contact for contacting said lamp.

7. The assembly of claim 3, including a substantially tubular metal lamp socket open at the top and bottom thereof for receiving a lamp, said socket compressively retained in the cylindrical opening of said moldment body.

8. The assembly of claim 7, wherein said tubular metal lamp socket is formed with a pair of opposed barbs extending outwardly and said cylindrical opening is formed with a pair of opposed recesses cooperating with said barbs for retaining said lamp socket in said opening.

9. The assembly of claim 1, wherein said moldment is formed from a silicon rubber having a natural frequency substantially less than the natural frequency of a lamp filament.

10. A shock isolating vehicle lamp assembly comprising:

a lamp housing defining a lamp cavity and a lens forming a front surface of said assembly;

a pair of opposed substantially parallel mounting tracks spaced apart from each other and disposed in said lamp housing within said cavity from the front to the rear of said housing;

a resilient shock isolating moldment adapted to be mounted on and between said mounting tracks, said moldment including a central body portion formed with a substantially cylindrical opening having a central axis for retaining a metal lamp socket, said moldment further including two pair of opposed substantially cylindrical spaced apart parallel arms extending outwardly in a plane perpendicular to said central axis of said moldment, each pair of arms joined to a transverse mounting bar, said mounting bars adapted to be engaged by said opposed pair of mounting tracks; and a substantially cylindrical metal lamp socket compressively retained in said opening.

11. The assembly of claim 10, wherein said moldment is formed from a silicon rubber having a natural frequency substantially less than the natural frequency of a lamp filament.

* * * * *